United States Patent [19]

Wong

[11] 4,124,198

[45] Nov. 7, 1978

[54] PLASTIC FENCE

[76] Inventor: Woon-Tong Wong, 14 Upton St., Boston, Mass. 02118

[21] Appl. No.: 838,626

[22] Filed: Oct. 3, 1977

[51] Int. Cl.[2] ..... E04H 17/16

[52] U.S. Cl. ..... 256/24; 256/73; 256/19

[58] Field of Search ..... 256/24, 25, 19, 65, 256/66, 73, 23; 52/243, 495; 160/135; 211/189, 182

[56] References Cited

U.S. PATENT DOCUMENTS

| | | | |
|---|---|---|---|
| 1,145,205 | 7/1915 | Mills, Jr. | 211/182 X |
| 1,464,305 | 8/1923 | Wilkey | 256/24 |
| 2,439,049 | 4/1948 | Lesko | 211/182 X |
| 3,332,182 | 7/1967 | Mark | 256/25 X |
| 3,471,129 | 10/1969 | Mpakarakes | 256/25 X |
| 3,700,213 | 10/1972 | Blease | 256/19 |
| 3,762,116 | 10/1973 | Anderson et al. | 52/495 X |
| 3,933,311 | 1/1976 | Lemelson | 256/24 X |
| 4,024,686 | 5/1977 | Gronert | 211/182 X |

*Primary Examiner*—Andrew V. Kundrat

*Attorney, Agent, or Firm*—Wolf, Greenfield & Sacks

[57] ABSTRACT

A plastic fence comprising easily interconnectable post sections including a base post section usually anchored in the ground and one or more shorter post sections capable of providing a fence of any desired height. The post sections may removably interconnect by a screw connection or a bayonet-type connection. In one embodiment individual struts connect horizontally between spaced post sections while in another embodiment panel means connect therebetween.

12 Claims, 6 Drawing Figures

FIG. 1
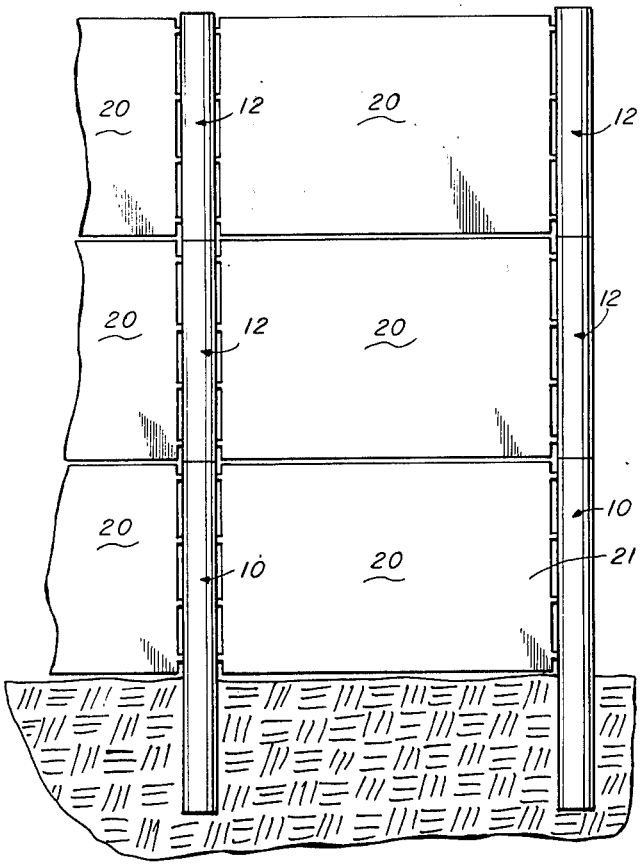
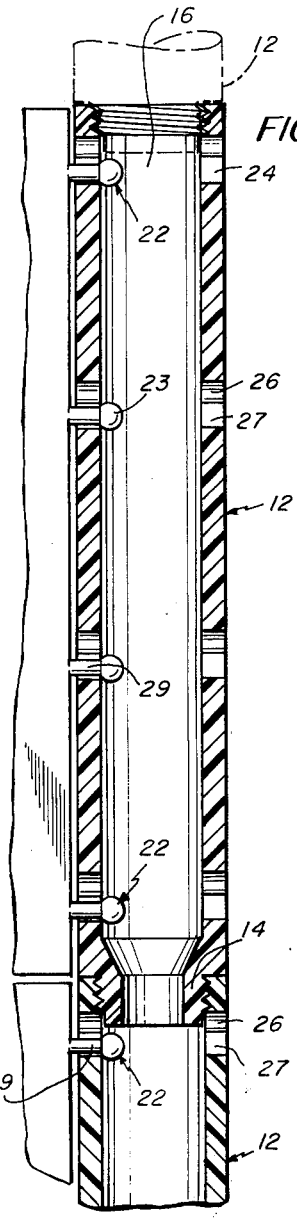
FIG. 2
FIG. 3
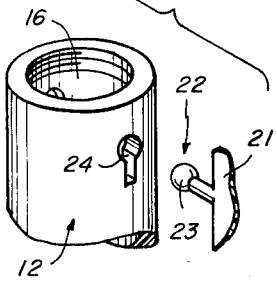
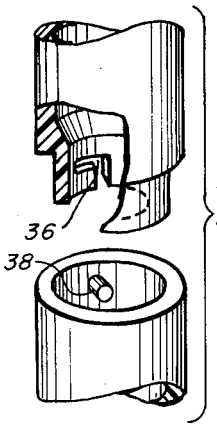
FIG. 6
FIG. 4
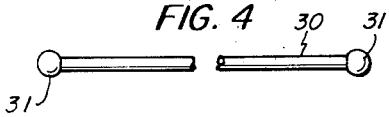
FIG. 5
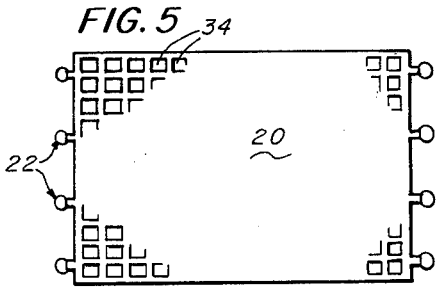

PLASTIC FENCE

BACKGROUND AND SUMMARY OF THE INVENTION

The present invention relates to an improved construction for a plastic fence. More particularly, this invention is concerned with a plastic fence constructed in easily interconnectable sections enabling the construction of fences of different heights.

Typical prior art plastic fences are shown in U.S. Pat. Nos. 3,700,213; 3,711,066; 3,720,401; and 3,537,687. One of the disadvantages associated with these prior art fences is that the fence is not easily adapted to construction in different heights. Further, some of the prior art arrangements provide interconnecting sections that are not easily disconnected. Other fence constructions in the prior art are rather complex.

Accordingly, one object of the present invention is to provide an improved plastic fence construction and one having easily interconnectable post sections so as to enable the construction of fences of any desired height.

A further object of the present invention is to provide a plastic fence constructed of components that are easily assembled and yet also easily disconnected.

Another object of the present invention is to provide a plastic fence that is of simple construction and that can be easily assembled even by a child.

Still another object of the present invention is to provide a plastic fence having post sections that are readily adapted to receive many different types of interconnecting members between post sections.

To accomplish the foregoing and other objects of this invention there is thus provided a plastic fence comprised of easily interconnectable post sections including a base post section usually anchored in the ground and one or more shorter post sections which interlock with the base post section. The number of upper post sections that are used will depend upon the desired height of the fence. In one embodiment the post sections interconnect by a screw thread while in an alternate embodiment a bayonet-type interconnection is provided. There are provided interconnecting struts or panels between spaced post sections to complete the construction of the plastic fence. The struts or panel means interconnect with the post section by having locking keys that mate with slots spacedly disposed along each of the post sections.

DESCRIPTION OF THE DRAWINGS

Numerous other objects, features and advantages of the invention should now become apparent upon a reading of the following detailed description taken in conjunction with the accompanying drawings, in which:

FIG. 1 is an elevation view of a plastic fence constructed in accordance with the principles of this invention;

FIG. 2 is a fragmentary cross-sectional view of a segment of the fence of FIG. 1 showing the post section in detail;

FIG. 3 is a fragmentary perspective view showing the interlocking arrangement at the post section;

FIG. 4 shows an alternate arrangement in the form of a strut for connecting between post sections;

FIG. 5 shows an alternate interconnecting panel means that has square holes therethrough; and FIG. 6 is a fragmentary cross-sectional view of an alternate embodiment of the connection between post sections.

DETAILED DESCRIPTION

FIGS. 1-3 show one embodiment of the present invention with the entire fence preferably constructed of plastic. The fence comprises a base post section 10 which may be approximately 18 inches long and one or more upper post sections 12 which may have a length of, for example, 12 inches. The base post section 10 is preferably anchored in the ground as shown in FIG. 1 to a depth of 6 inches or more. The bottom of the section 10 may be imbedded in concrete or one may simply provide a hole in the ground for the post section.

FIG. 2 is a cross-sectional view of the uppermost post section 12 showing the detailed construction thereof. Each of the post sections 12 may be of substantially the same construction and includes a bottom annular ridge 14 that is externally threaded and a top recess 16 that is internally threaded. FIG. 2 shows an upper post section 12 threaded with one disposed therebelow.

In the embodiment of FIGS. 1–3 the fence also comprises interconnecting panels 20 which connect between the vertically arranged post sections. In the embodiment of FIG. 1 there are three post sections vertically arranged. However, in alternate embodiments, additional post sections may be added to increase the height of the fence. Each panel 20 is constructed of a rectangular plastic sheet 21 having four keys 22 extending from both sides of the sheet 21. Each of the keys 22 comprises an enlarged end 23 which is preferably of spherical shape. In order to accommodate the panels 20 the post sections 12 are provided with keyhole slots 24 disposed diametrically on opposite sides of the post section 12. In the embodiment of FIGS. 1–3 wherein the panel 20 has four keys 22 there are also of course provided four keyhole slots 24.

FIG. 3 shows an exploded view with the key 22 in line with the keyhole slot 24. Each keyhole slot includes a larger top section 26 and a slotted bottom section 27. The keyhole slot 24 is dimensioned so that enlarged end 22 fits within the top portion of the slot with the bottom portion of the slot of a dimension to receive the cylindrical end 29 of the key 22. FIG. 2 shows the key 22 having been inserted through the top section 26 of the slot and resting with the cylindrical end 29 of the key in the bottom portion 27 of the slot 24. In this position the panel means is prevented from disengagement with the post section unless the panel is raised relative to the post section.

FIG. 4 shows an alternate arrangement that may replace the panel 20. In this embodiment in place of the panel there are provided four struts 30 each having an elongated cylindrical shape with ball ends 31 which are accommodated by the keyhole slots 24. These struts 30 are of a sufficient length to extend between the spaced vertically-arranged post sections. Typically, these struts may have a length of 18 inches.

FIG. 5 shows still a further embodiment of the present invention quite similar to that shown in FIG. 1. In this embodiment the panel means 20 is provided with a series of square or rectangular apertures 34 to provide a perforated panel. Other designs can be used for the panel 20 such as a design having triangular or diamond-shaped holes.

FIG. 6 shows a further alternative embodiment of the present invention. In this embodiment the interconnecting screw threads of the post sections are replaced by a bayonet-type interconnection including a slot 36 and associated stud 38 that interlocks with the slot for holding the post sections in proper vertical orientation.

The fence of this invention is quite easy to erect. After the post holes have been provided the fence may be erected in sections starting with the anchoring of the base post section 10. An adjacent base post section is then anchored in place with one of the panels 20 being interlocked between the base post sections. Thereafter, upper post sections 12 may be affixed above the base post section with additional panels being inserted between the post sections at the same horizontal level.

In order to lock the panels 20 relative to the post sections, as depicted in FIG. 2, it is noted that the annular flange 14 of each post section, when the post sections are interconnected, blocks a portion of the keyhole slot 24 so as to prevent any substantial raising of the panel 20. The spherical end 23 of the key 22 is blocked by the lower surface edge of the annular flange 14. In addition, at the top a cap may be provided as shown in phantom in FIG. 2 having a lower surface that also protrudes downwardly partially blocking the keyhole slot 24.

Having described a limited number of embodiments of the present invention it should now be apparent to those skilled in the art that there are numerous other embodiments contemplated as falling within the scope of this invention. For example, the plastic fence of this invention can be constructed in virtually any height and could even be constructed with post sections of different length. Also, the top post section may be left open to receive an object such as a flower pot.

What is claimed is:

1. A plastic fence comprising;

a plurality of like-diamter post sections each having means for interconnecting the post sections linearly in vertical array, in at least two parallel arranged groups with one secton of each group for anchoring the group in the ground, and means supported between the post section groups including key means extending toward each group, said post sections each having key slot means spacedly disposed therealong in at least two diametrically disposed sets for receiving the key means, said means for interconnecting comprising mating thread means of adjacent post sections including a female portion of one section and a reduced-diameter male portion of the other section, at least one of said key slot means of said one section being sufficiently proximate said female portion so that said male portion at least partially blocks the key slot means to prevent the key means associated therewith from disengaging from the key slot means.

2. A plastic fence as set forth in claim 1 wherein the mating means means includes a bayonet-type connection.

3. A plastic fence as set forth in claim 1 wherein the group of post sections include a longer section for anchoring in the ground, all said post sections being of elongated, hollow, cylindrical shape therealong in two sets diametrically disposed to each other.

4. A plastic fence as set forth in claim 3 wherein each keyhole slot has different slot widths and each key means has an enlarged end.

5. A plastic fence as set forth in claim 4 wherein said means supported between the groups includes a plurality of elongated struts each having the key means formed at ends thereof.

6. A plastic fence as set forth in claim 1 wherein said means supported between the post sections includes panel means.

7. A plastic fence as set forth in claim 1 wherein said means supported between the post sections includes strut means.

8. A plastic fence as set forth in claim 1 wherein said key means has a cylindrical portion and a spherical end and said key slot means has a round slot contiguous with an elongated slot.

9. A plastic fence as set forth in claim 8 wherein said male portion only blocks said round slot, said spherical end being dimensioned to be locked in said elongated slot.

10. A plastic fence comprising;

a plurality of like-dimaeter post sections each having means for interconnecting the post sections linearly in vertical array and in at least two separate spaced parallel-disposed groups with one section of each group for anchoring the group, and filler means supported between the post section groups including key means extending toward each group, said post sections each having key slots spacedly longitudinally disposed therealong in two sets diametrically disposed to each other, each slot for receiving a key of the key means, said means for interconnecting comprising mating thread means of adjacent post sections including a female portion of one section and a male portion of the other section and with one of said portions being sufficiently proximate at least one of said key slots when assembled to prevent disengagement of said key, at least the top post section of a group being open to provide a means for supporting an item on the top of the fence.

11. A plastic fence as set forth in claim 10 wherein said top post section has the male portion at the bottom thereof to mate with a female portion of the next lower post section, and the female portion at the top thereof providing a sufficiently wide opening to receive said item.

12. A plastic fence as set forth in claim 1 wherein said male portion blocks two diametrically disposed adjacent slots.

* * * * *